United States Patent [19]

LeTixerant et al.

[11] 4,343,136

[45] Aug. 10, 1982

[54] HARNESSING SYSTEM FOR LUNGING HORSES

[76] Inventors: Eric LeTixerant, 8, rue Erlanger, 75016 Paris; Philippe LeTixerant, 66, rue Ponsardin, 51100 Reims, both of France

[21] Appl. No.: 145,691

[22] Filed: May 1, 1980

[30] Foreign Application Priority Data

May 4, 1979 [FR] France ..... 79 11238
Nov. 15, 1979 [FR] France ..... 79 28238

[51] Int. Cl.[3] ..... B68B 1/04
[52] U.S. Cl. ..... 54/14; 54/16; 54/13
[58] Field of Search ..... 54/13, 14, 16, 35, 36, 54/57, 70, 71

[56] References Cited

U.S. PATENT DOCUMENTS

| | | | |
|---|---|---|---|
| 122,491 | 1/1872 | Robbins | 54/16 |
| 173,188 | 2/1876 | Selover | 54/16 |
| 191,957 | 6/1877 | Haas | 54/36 |
| 343,585 | 6/1886 | Jandrue | 54/36 X |
| 531,753 | 1/1895 | Smith | 54/14 |
| 2,041,044 | 5/1936 | Bourn | 54/1 |

FOREIGN PATENT DOCUMENTS

| | | | |
|---|---|---|---|
| 1526032 | 9/1978 | United Kingdom | 54/35 |

*Primary Examiner*—Gene Mancene
*Assistant Examiner*—Robert P. Swiatek
*Attorney, Agent, or Firm*—Watson, Cole, Grindle & Watson

[57] ABSTRACT

Supplemental head equipment for lunging horses, comprising a sliding head-piece resting against the nape of a horse's neck and including rings and releasable fasteners for connection to a convention head-stall.

4 Claims, 4 Drawing Figures

1
2
3
4
5
6
7
8
9
10
11
12
13
14
15
16
17
18
19
20
21
22

HARNESSING SYSTEM FOR LUNGING HORSES

The invention relates to a harnessing system for lunging horses, which comprises in addition to the conventional head-stall a head piece and a lunge.

Harnessing arrangements fitted about the head of a horse permit the horse to be directed or lunged while being ridden or only led.

Four are normally used by the equestrian.

For example, the barnum is a coercive means permitting the horse to be held back and forcing it to yield. However, such cannot be used for making the horse turn around gently within its three paces. The cavesson allows the equestrian to pass from right hand lead to left hand lead without modifying the attachment of the lunge, but is difficult to use with young horses. Besides, this device is often ineffective with difficult horses or too hard with delicate horses and leads to inverted working attitudes (head up). Moreover a lack of steadiness is disappointing in the case of horses that throw the bit and it is not possible to adapt the conventional working arrangement of the reins to the cavesson.

The direct lunge is fixed at one of the rings of the snaffle rein. However, this simple means does not permit the horse's head to be controlled in a vertical plane. On the contrary, it favours a lateral inclination and some resistance in the direction opposite the action of the lunge. In the latter case it is accompanied with an exaggerated displacement of the bit, which may even cause the horse's mouth to be cut.

And, the so-called Colbert lunge, which passes through one of the rings of the snaffle, and then along the nape of the horse's neck before being fastened to the ring of the opposed snaffle, provides the best lunging efficiency as evidenced by the results actually obtained. The upward stresses on the bit resulting therefrom are thus then more evenly distributed.

However, direct actuation of the bit may not be easy and requires particular reactions. The Colbert lunge is therefore not sufficiently coercive for effectively eliminating the need for such reactions.

Moreover, the complexity of the controlling movements when changing the lead and the inversion of the attachments may frighten a young or delicate animal. Because of that the operator would have little chance to ward off the risk and danger of a horse breaking off forcibly.

The present device avoids the inconveniences of the conventional arrangements of reins mentioned above.

The invention retains the beneficial effects of the Colbert lunge but also provides:

a complementary resilience;

ease of use, due to the fact that the lunge is no longer directly connected with the bit;

some security by reason of an attachment system which permits the main arrangement to remain fixed on the horse's head while the use of a forked lunge permits the lead to be inverted without losing control of the horse at any time;

and the ease of setting the equipment in place, a main harnessing piece being simply slid over the horse's neck and fastened effectively and smoothly to the bit.

Other objects, advantages and novel features of the invention will become more apparent from the following detailed description of the invention, wherein.

Figures 1, 2, 3:
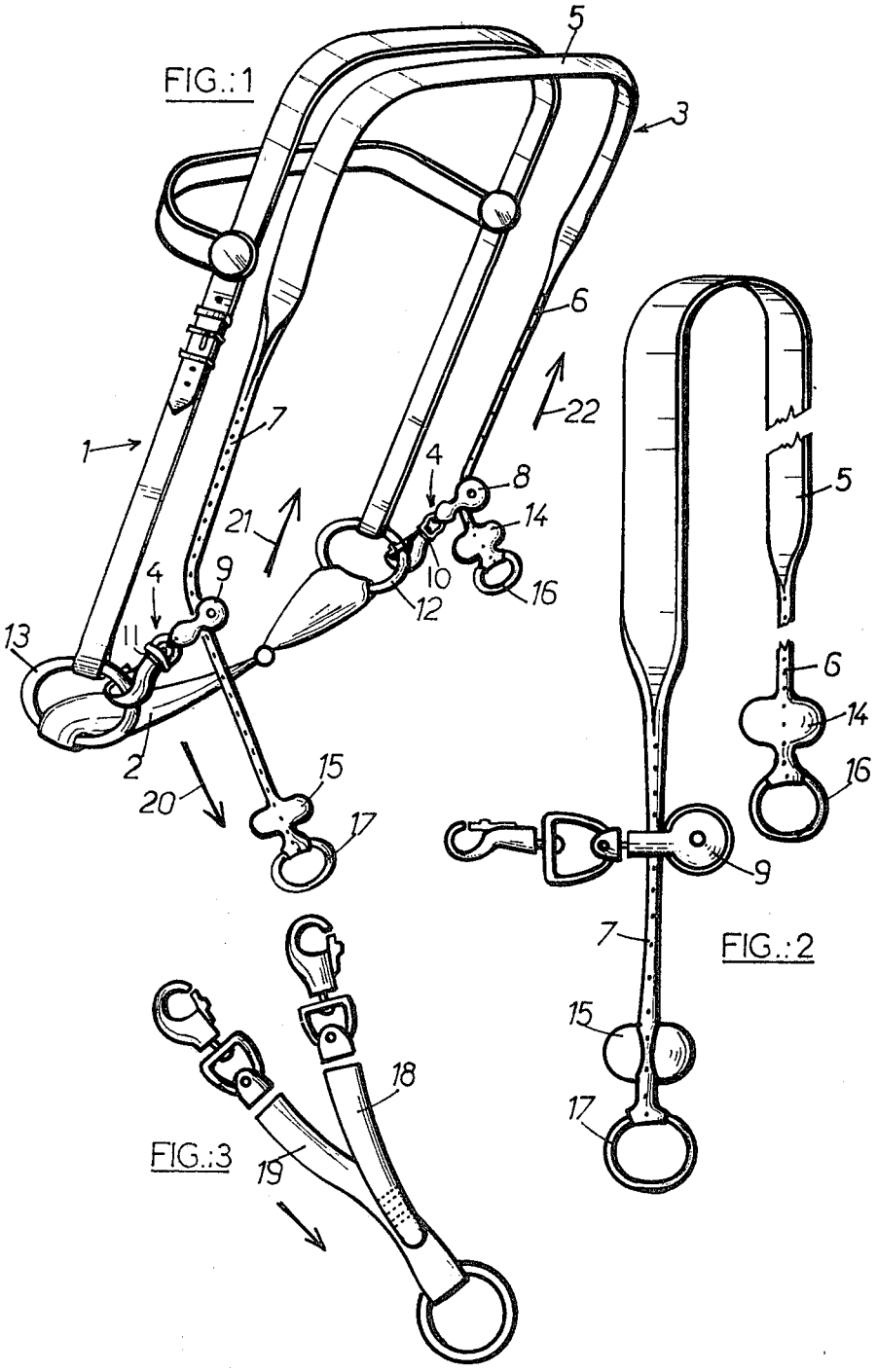
FIG. 1 is a perspective view of a conventional head-stall with which the head piece according to the invention is connected.
FIG. 2 is a perspective view of a first embodiment of the head piece according to the invention.
FIG. 3 is a perspective view of a part of a forked lunge that forms together with the head piece the equipment according to the invention.

FIG. 1 shows a conventional head-harnessing arrangement or head-stall 1 to which a mouth piece or bit 2 is fixed. The supplemental head equipment according to the invention is generally designated 3 and is fixed to the harnessing arrangement 1 by linking elements 4 which will be described more fully hereinafter.

The supplemental head equipment shown in FIGS. 1 to 3 comprises a head piece 5 made of leather, canvas or any other suitable material, having a central curved part in the form of a plain band adapted to rest on the nap of a horse's neck.

Two end parts 6 and 7 of head piece 5 are respectively curled to form a connection or "tie" of substantially round section which permits them to be easily inserted through holes (not shown) and slid on two pulleys 8 and 9 which are connected through intermediate swivel snap-hooks 10 and 11 connected to two rings 12 and 13 at opposite ends of bit 2.

The end parts or "ties" 6 and 7 of the head piece are provided with stop blocks 14 and 15 made of leather or other suitable material having attached rings 16 and 17 which link up with either one of two shanks 18 or 19 of a forked lunge (only the end of which is shown in FIG. 3) which may be adapted thereto.

The equipment according to the invention permits the horse to be held and, at the same time, permits application of a balanced, progressive and symmetrical action on bit 2 through the intermediary of the ties 6, 7 sliding on the pulleys 8, 9.

When lunging with a left hand lead, the stop-block 14 which strikes against pulley 8 determines the requisite fixed point while the left-hand tie 7 that slides (in the direction of arrow 20) on the pulley 9 according to the action of the lunge connected thereto produces the uniform tensions (directed as shown by the arrows 21, 22) caused by the operator. Head piece 5, resting on the nape of the neck, moves in the direction of arrow 20.

When changing the lead, one of the parts 18 or 19 of the forked lunge is unfastened from the ring 17 and fastened to the ring, 16 and the operation proceeds in a like manner as aforedescribed so as to invert the lead while holding the horse by the operator without interruption.

Figure 4:
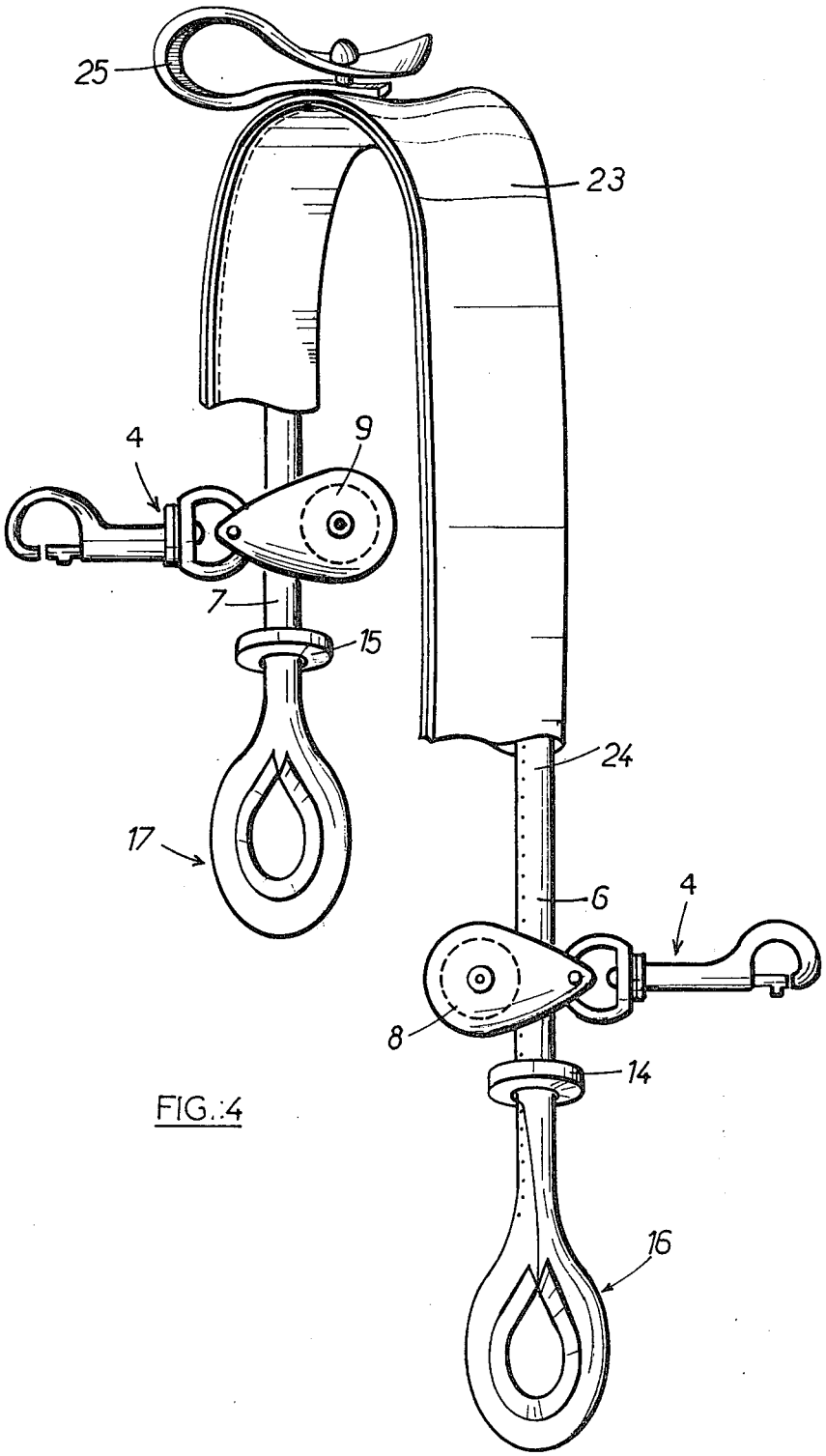
FIG. 4 is a perspective view of a second embodiment of the head piece according to the invention.

A according to another embodiment shown in FIG. 4, the head piece 5 is formed by a sheath 23 made of leather, canvas or other suitable material, adapted to rest against the nape of the animal's neck. In this representation, parts similar to those of the first embodiment are designated by the same reference numerals. A common tie 24 slides within sheath 23, and opposite ends 6 and 7 thereof terminate in rings 16 and 17 having stop-blocks 14 and 15 thereon.

Ends 6 and 7 of tie 24 extend through pulleys 8 and 9 having swivel catch-hooks 10 and 11 mounted thereon. An attachment buckle 25 permits sheath 23 to be connected to head-stall 1 (FIG. 1).

We claim:

1. Supplemental head equipment attached to a conventional horse head-stall having bit rings and to a lunge for the purpose of lunging a horse, comprising a head piece having a central substantially U-shaped portion adapted to rest against the nape of the horse's neck, the central portion of the head piece comprising a sheath having open ends, and a tie element extending through the sheath and having end parts at opposite ends thereof adapted to lie on either side of the neck, a pair of linking elements each including a releasable fastener at one end thereof for attachment to a respective bit ring of the head-stall, the elements also each including a rotatable pulley at the other end thereof spaced from the fastener, the end parts extending partially about the pulleys and through the spacings between the pulleys and the fasteners, the end parts terminating at predetermined distances from the pulleys and having stop blocks adjacent the terminal ends thereof which strike against one or the other of the pulleys when lunging the horse with a left hand or right hand lead, and ring-shaped elements secured to the terminal ends of the end parts for attachment of the head piece with the lunge.

2. The head equipment according to claim 1, wherein the end parts are substantially round in cross-section.

3. The head equipment according to claim 1, wherein the sheath is provided with an attachment buckle adapted to be connected with the head-stall.

4. The head equipment according to claim 1 in combination with the lunge which comprises a pair of shanks attached together at one end and having swivel catch-hooks at the opposite ends thereof, the hooks engaging one or the other of the ring-shaped elements on the end parts for leading the horse either on left hand or right hand when lunging.

* * * * *